US006800013B2

(12) United States Patent
Liu

(10) Patent No.: US 6,800,013 B2
(45) Date of Patent: Oct. 5, 2004

(54) INTERACTIVE TOY SYSTEM

(75) Inventor: Shu-Ming Liu, No. 32, Lane 75, Sec.3, Kang-Ning Rd., Taipei City (TW)

(73) Assignee: Shu-Ming Liu, Taipei (TW)

( * ) Notice: Subject to any disclaimer, the term of this patent is extended or adjusted under 35 U.S.C. 154(b) by 284 days.

(21) Appl. No.: 09/683,976

(22) Filed: Mar. 7, 2002

(65) Prior Publication Data

US 2003/0124954 A1 Jul. 3, 2003

(30) Foreign Application Priority Data

Dec. 28, 2001 (TW) ..... 90132992 A

(51) Int. Cl.[7] ..... A63H 30/00
(52) U.S. Cl. ..... 446/297; 446/484
(58) Field of Search ..... 446/297, 298, 446/299, 300, 301, 302, 303, 484

(56) References Cited

U.S. PATENT DOCUMENTS 6,012,961 A * 1/2000 Sharpe et al. ..... 446/298
6,290,566 B1 * 9/2001 Gabai et al. ..... 446/175
6,319,010 B1 * 11/2001 Kikinis ..... 434/169

FOREIGN PATENT DOCUMENTS

| | | |
|---|---|---|
| TW | 437425 | 5/2001 |
| TW | 462163 | 11/2001 |

* cited by examiner

*Primary Examiner*—Jacob K. Ackun
(74) *Attorney, Agent, or Firm*—Winston Hsu

(57) ABSTRACT

An interactive toy has a microphone, a speaker, a memory for storing a toy identifier, and an interface to provide communications with a computer system. The computer system connects to a server on a network. The interactive toy provides electrical signals from the microphone, as well as the toy identifier, to the computer system via the interface. The interface enables the computer system to control the speaker to generate audible information according to data received from the server. Alternatively, a processor and memory with networking capabilities may be embedded within the toy to eliminate the need for a computer system.

15 Claims, 3 Drawing Sheets

INTERACTIVE TOY SYSTEM

BACKGROUND OF INVENTION

1. Field of the Invention

The present invention relates to an interactive toy. In particular, the present invention discloses a toy that downloads information from the Internet in response to a verbal command.

2. Description of the Prior Art

Interactive toys have been on the market now for quite some time. By interactive, it is meant that the toy actively responds to commands of a user, rather than behaving passively in the manner of traditional toys. An example of such interactive toys is the so-called electronic pet. These electronic pets have a computer system that is programmed to adapt to and "learn" verbal commands from a user. For example, in response to the command "Speak", a virtual pet may emit one of several pre-programmed sounds from a speaker embedded within the pet.

Although quite popular, interactive toys all suffer from the same problem: Once manufactured, the programmed functionality of the toy is fixed. The toy may appear flexible as the processor within the toy learns and adapts to the speech patterns of the user. In reality, however, the program and corresponding data embedded within the toy, which the processor uses, are fixed. The repertoire of sounds and tricks within the toy will thus all eventually be exhausted, and the user will become bored with the toy.

SUMMARY OF INVENTION

It is therefore a primary objective of this invention to provide an interactive toy that is capable of connecting to a server to expand the functionality range of the toy.

Briefly summarized, the preferred embodiment of the present invention discloses an interactive toy. The interactive toy has a microphone, a speaker, a memory for storing a toy identifier, and an interface to provide communications with a computer system. The computer system connects to a server on a network. The interactive toy provides electrical signals from the microphone, as well as the toy identifier, to the computer system via the interface. The interface enables the computer system to control the speaker to generate audible information according to data received from the server. Alternatively, a processor and memory with networking capabilities may be embedded within the toy to eliminate the need for a computer system.

It is an advantage of the present invention that by connecting to the server on the network, the interactive toy may expand its built-in functionality. The server can effectively act as a warehouse for new commands, which can be continually updated. In this manner, a user is less likely to become bored with the interactive toy.

These and other objectives of the present invention will no doubt become obvious to those of ordinary skill in the art after reading the following detailed description of the preferred embodiment, which is illustrated in the various figures and drawings.

DETAILED DESCRIPTION

Figure 1:
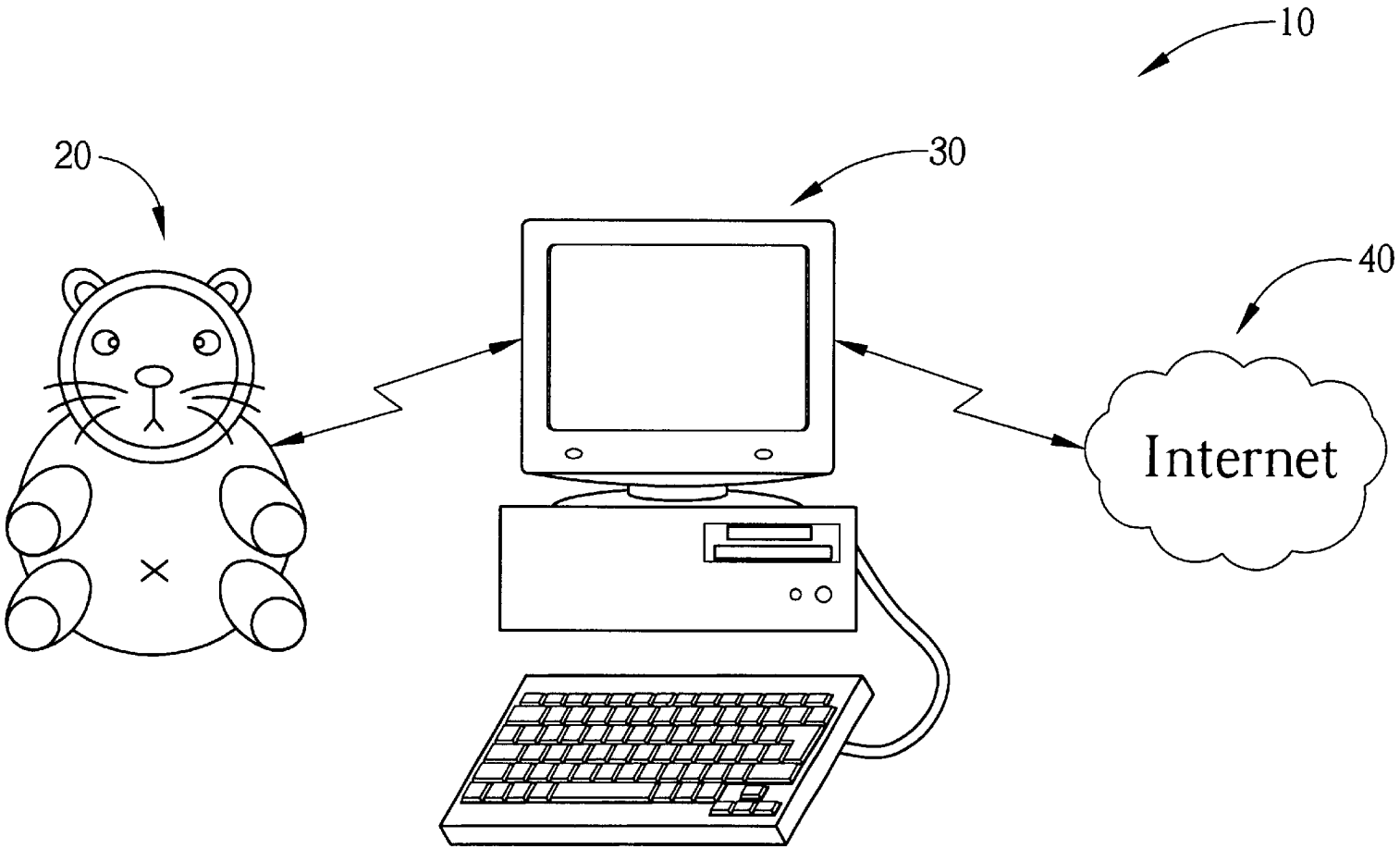
FIG. 1 is a perspective view of a first embodiment interactive toy system according to the present invention.
Figure 2:
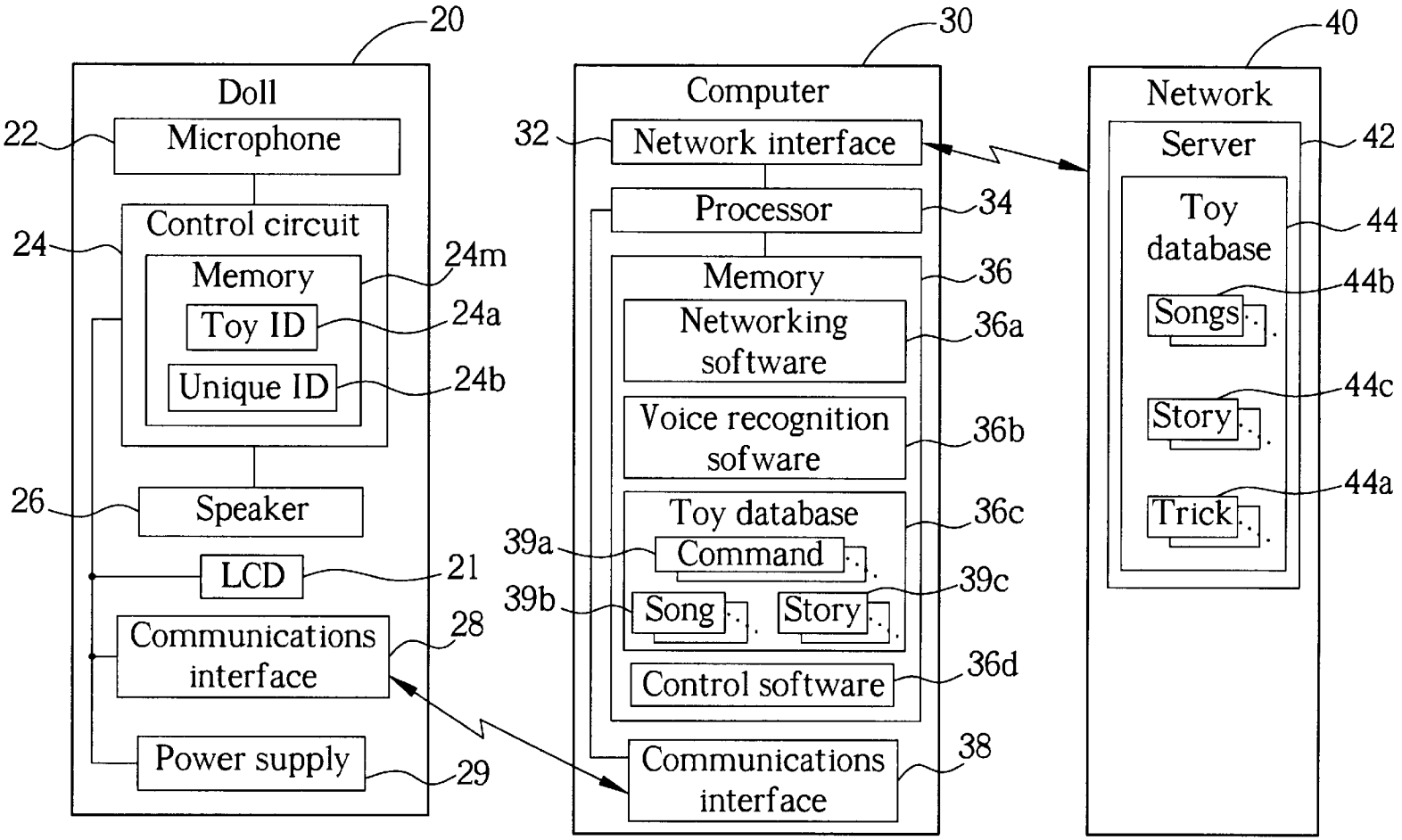
FIG. 2 is a block diagram of an interactive toy and computer depicted in FIG. 1.

Please refer to FIG. 1 and FIG. 2. FIG. 1 is a perspective view of a first embodiment interactive toy system 10 according to the present invention. FIG. 2 is a block diagram of the interactive toy system 10. The interactive toy system 10 includes a doll 20 in communications with a computer 30. The computer 30, in turn, is in communications with a network 40, which for the present discussion is assumed to be the Internet. The doll 20 includes a microphone 22, a speaker 26, and a communications interface 28, all electrically connected to a control circuit 24. A power supply 29, such as a battery, provides electrical power to the control circuit 24. The control circuit 24 accepts signals from the microphone 22, and passes corresponding signals to the communications interface 28. The communications interface 28 transmits information to the computer 30 that corresponds to the signals from the microphone 22. Similarly, the communications interface 28 may receive information from the computer 30. This information is passed to the control circuit 24, which uses the information to control the speaker 26. This causes the speaker 26 to generate audible information for a user. Under this setup, the doll 20 can pass information to the computer 30 that corresponds to words spoken by a user into the microphone 22. Similarly, the computer 30 uses the communications module 28 to generate audible information with the speaker 26. The computer 30 thus acts as the "brains" of the doll 20. The doll 20 simply has a minimum amount of circuitry 24 and 28 to support transmission, reception and appropriate processing of relevant information.

The computer 30 includes a network interface 32, a memory 36 and a communications interface 38, all electrically connected to a processor 34. The computer 30 may be a standard desktop or laptop personal computer (PC). The network interface 32 is used to establish a physical networking connection with the network 40, and may include such items as a networking card, a modem, cable modem, etc. Installed within the memory 36, and executed by the processor 34, is networking software 36*a*. The networking software 36*a* works with the network interface 32, and in particular, has the ability to establish a connection with a server 42 on the network 40. As is well known in the art, the networking software 36*a* is designed to work with other software packages, such as a control software package 36*d*, to give such software networking abilities.

Voice recognition software 36*b*, a related toy database 36*c*, and the control software 36*d* are included with the doll 20 as a total product, in the form of a computer-readable media, such as a CD, a floppy disk, or the like. The user then employs this computer-readable media to install the voice recognition software 36*b*, the toy database 36*c*, and the control software 36*d* into the memory 36 of the computer. The communications interface 38 of the computer 30 corresponds to the communications interface 28 of the doll 20, and the control software 36*d* is designed to control the communications interface 38 to send and receive information from the doll 20, and to work with the networking software 36*a* to send and receive information from the server 42. The communications interfaces 28 and 38 may employ a wireless connection (as in an IR transceiver, a Bluetooth module, or a custom-designed radio transceiver), or a cable connection (such as a USB port, an RS-232 port, a parallel port, etc.). The toy database 36*c* includes a plurality of commands 39*a*, and output audio data files such as songs 39*b* and stories 39*c*. Each command 39*a* is in a form for use by the voice recognition software 36*b*. With input audio data provided to the voice recognition software 36*b*, the voice recognition software 36*b* will select one of the commands 39*a* that most closely corresponds to the input audio data.

The general operational principle of the interactive toy system 10 is as follows. A user speaks a command into the microphone 22, such as "sing a song". These spoken words generate corresponding electrical signals, which the control circuit 24 accepts from the microphone 22. The control circuit 24 passes these signals on to the communications interface 28 for transmission to the computer 30. The communications interface 28 modulates the signals according to the physical type of interface 28 being used, and then transmits a modulated signal to the computer 30. The corresponding communications interface 38 on the computer 30 demodulates the signal from the doll 20, to provide the signals generated from the microphone 22 to the control software 36*d*. The control software 36*d* then provides this spoken-word data to the voice recognition software 36*b*. The voice recognition software 36*b* parses the spoken-word data, comparing it against the commands 39*a* in the toy database 36*c*, to select a closet-matching command 39*a*, and so informs the control software 36*d*. According to which of the commands 39*a* was selected by the voice recognition software 36*b*, the control software 36*d* will send control commands to the doll 20 to instruct the control circuit 24 to have the doll 20 perform a certain task. For example, if the spoken-word command of the user was, "sing a song", the control software 36*d* will select one of the song audio output files 39*b*, and stream the data to the control circuit 24 so that the speaker 26 will generate a corresponding song. Alternatively, if the spoken-word instructions of the user had been, "tell a story", the control software 36*d* would select one of the story audio output files 39*c*, and send the data to the control circuit 24 so that the speaker 26 generates a corresponding audible story. Other commands, such as "sit" or "wave" are also possible, with the control circuit 24 controlling the doll 20 according to instructions received from the computer 30 from the control software 36*d*. In particular, however, the user may wish for something new after the current repertoire of the toy database 36*c* has been exhausted and re-used to the point of boredom. For example, the user may issue the spoken-word commands "new song", "new story", or "new trick". A corresponding command 39*a* is picked by the voice recognition software, and the control software 36*d* responds by instructing the networking software to connect to the server 42 on the network 40. The control software 36*d* negotiates with the server 42 to obtain a new trick 44*a*, song 44*b* or story 44*c* from a toy database 44 on the sever 42. The new trick 44*a*, song 44*b* or story 44*c* obtained from the server 42 should be one that is not currently installed in the toy database 36*c* of the computer 30. For example, in response to a spoken-word command "new story", and corresponding command 39*a*, the control software 36*d* uses the networking software 36*a* to negotiate with the server 42 for a new story audio output file 44*c*. This new story audio output file 44*c* is downloaded into the toy database 36*c*, and further passed on to the control circuit 24 by the control software 36*d* via the communications interfaces 38 and 28. In this manner, the user is able to hear a new story that he or she had not previously heard from the doll 20.

Of particular importance is that, within the control circuit 24 of each doll 20, there is memory 24*m* that holds a toy ID 24*a*. This toy ID 24*a* indicates the type of the doll 20; for example, a different toy ID 34*a* would be used for a fuzzy bear, a super-hero, an evil villain, etc. This toy ID 24*a* is provided by the control circuit 24 to the computer 30 via the communications interfaces 28 and 38. The control software 36*d* may issue a command to the control circuit 24 that explicitly requests the toy ID 24*a*, or the toy ID 24*a* may be provided by the control circuit 24 during initial setup and handshaking procedures between the doll 20 and computer 30. In either case, during negations with the server 42 for a new song, story, or trick, the control software 36*d* provides the toy ID 24*a* to the server 42. The server 42 responds by providing a trick 44*a*, song 44*b* or story 44*c* that is appropriate to the type of doll 20 according to the toy ID 24*a*. Distinct character types and mannerisms for different dolls 20 may thus be maintained by way of the toy ID 24*a*. That is, each doll 20 according to the present invention is provided a set of songs, stories and tricks that are consistent with the morphology of the doll 20, as indicated by the toy ID 24*a*.

This idea may be carried even further by providing a unique ID 24*b* within the memory 24*m* of each doll 20. No doll 20 would have a unique ID 24*b* that is the same as that for another doll 20. As with the toy ID 24*a*, the unique ID 24*b* is provided to the control software 36*d*, which, in turn, provides this unique ID 24*b* to the server 42 during negotiations for a new trick 44*a*, song 44*b* or story 44*c*. The server 42 may thus keep track of every trick 44*a*, song 44*b* or story 44*c* downloaded in response to a particular doll 20, and thus prevent repetitions of trick, songs and stories. Consequently, though the toy database 36*c* on the computer 30 may become corrupted or destroyed, the network server 42, by tracking with the unique ID 24*b*, can still provide new data from the toy database 44, and even help to restore the toy database 36*c* to its original condition on the computer 30.

As a final note for the doll 20, the doll 20 may further be provided with a liquid crystal display (LCD) 21 that is electrically connected to the control circuit 24. The control software 36*d* may issue commands to the control circuit 24 directing the control circuit 24 to present information of the LCD 21.

Figure 3:
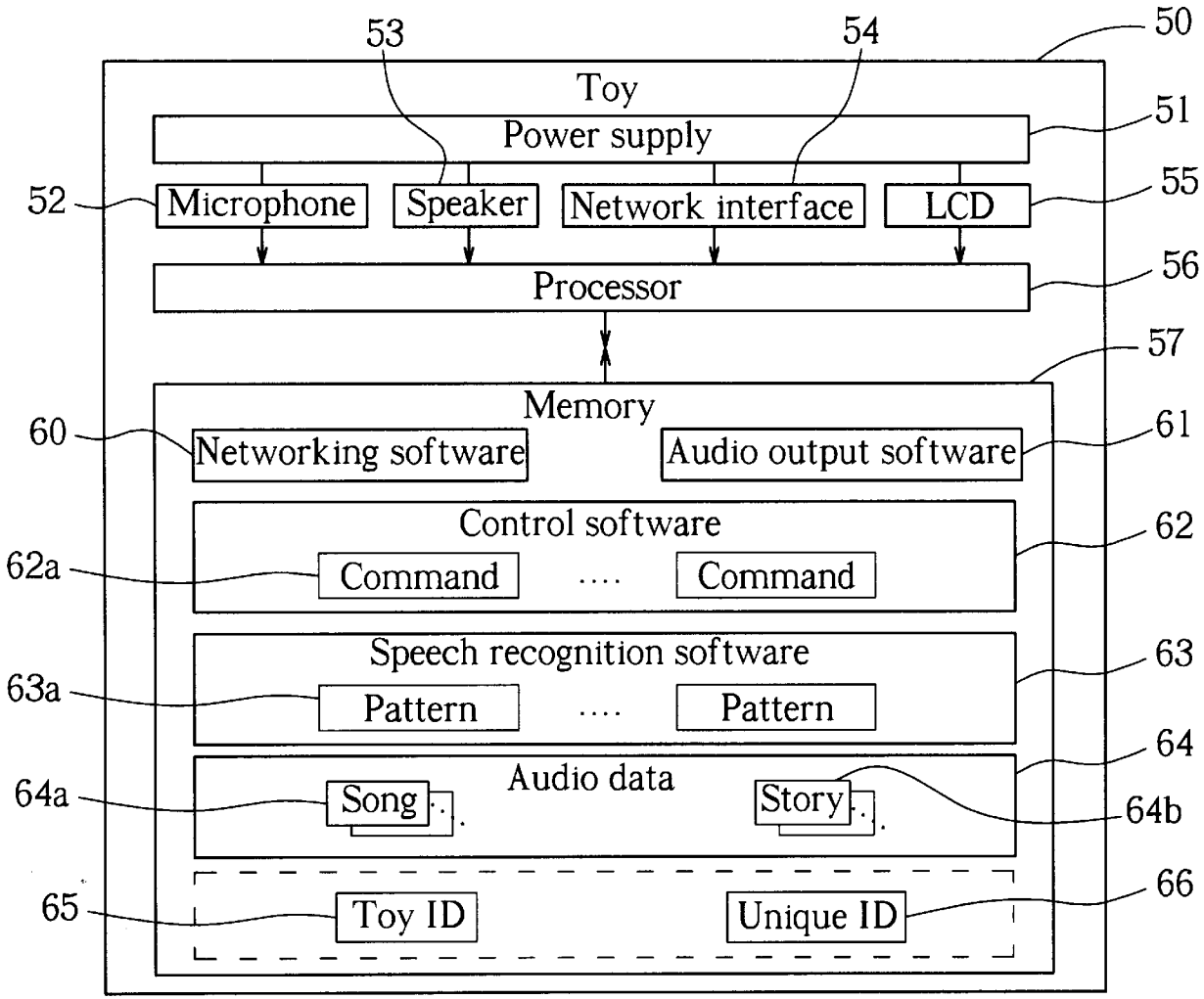
FIG. 3 is a functional block diagram of a second embodiment interactive toy according to the present invention.

A considerably more sophisticated version for an interactive toy according to the present invention is also possible. Please refer to FIG. 3 with reference to FIG. 2. FIG. 3 is a functional block diagram of a second embodiment interactive toy 50 according to the present invention. The toy 50 is network-enabled so as to be able to directly connect to the network 40 and communicate with the server 42. The toy 50 includes a power supply 51, a microphone 52, a speaker 53, a network interface 54, an LCD 55, a processor 56 and a memory 57. The power supply 51 provides electrical power to all of the components of the toy 50, and may be a battery-based system or utilize a power converter. The microphone 52 sends electrical signals to the processor 56 according to acoustic energy impinging on the microphone 52. The microphone 52 is designed to accept verbal commands from a user, and provide corresponding electrical signals of these verbal commands to the processor 56. The speaker 53 is controlled by the processor 56 to generate audible information for the user, such as the singing of a song, the telling of a story, generating phrases or funny sounds, etc. The network interface 54 is used to establish a network connection with the server 42 on the network 40. The network interface 54 may employ a modem, a cable modem, a network card, or the like to physically connect to the network 40. The network interface 54 may even establish communications with a computer (via a USB port, an IR port, or the like) to use the computer as a gateway into the network 40. The LCD 55 is used to present visual information to the user, and is controlled by the processor 56.

The memory 57 comprises a plurality of software programs that are executed by the processor 56 to establish the functionality of the toy 50. In particular, the memory 57 includes networking software 60, audio output software 61, control software 62, speech recognition software 63, audio data 64, a toy ID 65 and a unique ID 66. The memory 57 is a non-volatile, readable/writable type memory system, such as an electrically erasable programmable ROM ($E^2$ROM, also know as flash memory). The toy ID 65 and unique ID 66 may optionally be stored in a ROM 70 serving as a second memory system so as to avoid any accidental erasure or corruption of the toy ID 65 and unique ID 66. The networking software 60 works with the network interface 54 to establish a communications protocol link with the server 42, such as a TCP/IP link. The audio output software 61 uses the audio data 64 to control the speaker 53. The control software 62 is in overall control of the toy 50, and has a plurality of commands 62*a*. Each command 62*a* corresponds to a specific functionality of the toy 50, such as the singing of a song, the telling of a story, stop, cue backwards, cue forwards, or the performing of tricks like sitting, standing, laying down, etc. In particular, at least one of the commands 62*a* corresponds to the toy 50 obtaining a new trick or audio data from the server 42 from over the network 40. The speech recognition software 63 processes the electrical signals received from the microphone 52, and holds a plurality of command speech formats 63*a*. Each of the command speech formats 63*a* holds speech patterns that correspond to one of the commands 62*a* of the control software 62. The speech recognition software 63 analyzes the electrical signals from the microphone 52 according to the speech patterns 63*a*, and selects the speech pattern 63*a* that most closely fits the user's instructions that are spoken into the microphone 52. The speech pattern 63*a* selected by the speech recognition software 63 has a corresponding command 62*a*, and this command 62*a* is then performed by the control software 62. The audio data 64 comprises song files 64*a* that each hold audio data for a song, and story files 64*b* that each hold audio data for a spoken-word story. Other data may also be stored in the audio data 64, such as interesting or informative sounds.

Verbal commands of a user are picked up by the microphone 52, which generates electrical signals that are sent to the processor 56. Executed by the processor 56, the speech recognition software 63 analyzes the electric signals from the microphone 52 to find a speech pattern 63*a* that most closely matches the verbal command of the user. The speech recognition software 63 then indicates to the control software 62 which of the speech patterns 63*a* was a closest-fit match (if any). The control software 62 then performs the appropriate, corresponding command 62*a*. For example, if the corresponding command 62*a* indicated that a sung should be sung, performing of the command 62*a* causes the control software 62 to select a song file 64*a* from the audio data 64, and provide this song file 64*a* to the audio output software 61. The audio output software 61 analyzes the data in the song file 64*a*, and sends corresponding signals to the speaker 53 so that the speaker generates sounds according to the song file 64*a*. In this manner, the toy 50 provides a song to the user as verbally requested.

In particular, though, in response to a command 62*a* as determined from the speech recognition software 63 from a verbal command of the user, the control software 62 utilizes the networking software 60 to negotiate with the server 42 over the network 40 to obtain a new trick 44*a*, song 44*b* or story 44*c* from the toy database 44 of the server 42. Assuming that the network interface 54 has a successful physical connection to the network 40 (through a telephone line, a networking cable, via a gateway computer, etc.), the following steps occur:1)The control software 62 instructs the networking software 60 to establish a network protocol connection with the server 42.

2)Upon successful creation of a network connection with the server 42, the control software 62 negotiates with the server 42 (by way of the networking software 60) for access to the server 42. This may include, for example, a login name and password combination. At this time, the control software 62 provides both the toy ID 65, and the unique ID 66, to the server 42.

3)Upon the granting of access to the server 42, the control software 62 indicates the new item type desired from the toy database 44, such as a trick 44*a*, song 44*b* or story 44*c*. If the control software 62 explicitly requests a particular trick 44*a*, song 44*b* or story 44*c*, then the server 42 responds by providing the explicitly desired trick 44*a*, song 44*b* or story 44*c* to the toy 50. Alternatively, by tracking with the unique ID 66, the server 42 may decide which new trick 44*a*, song 44*b* or story 44*c* is to be provided to the toy 50. In either case, the control software 62 downloads the audio data of the new song 44*b* or story 44*c*, storing and tagging the new audio data in the audio data region 64 of the memory 57. A new downloaded trick 44*a* generates a new command 62*a* in the control software 62, with a corresponding speech pattern 63*a* tag, and may also have corresponding audio data stored in the audio data region 64. As flash memory is used, the newly updated audio data 64, commands 62*a* and speech patterns 63*a* will not be lost when the toy 50 is turned off. The trick 44*a*, song 44*b* or story 44*c* downloaded by the control software 62 from the server 42 should be consistent with the morphology of the toy 50 as indicated by the toy ID 65.

4)Audio data corresponding to the new trick 44*a*, song 44*b* or story 44*c* is provided to the audio output software 61 by the control software 62. The audio output software 61 controls the speaker 53 so that the user may hear the new song 44*b*, story 44*c*, or sounds associated with the new trick 44*a*.

In contrast to the prior art, the present invention provides a server that acts as a warehouse for new functions of the interactive toy of the present invention. The toy, in combination with the server, may thus be thought of as an interactive toy system. This interactive toy system provides the potential for continuously expanding the functionality of the toy. New features are provided to the toy by the server according to a toy ID, as well as by a unique identifier. The toy, either directly or through a personal computer, connects with the server through the Internet to obtain a new function. The server may track functions downloaded to the toy by way of the unique identifier, and in this way functionality can be added to without repetition, or restored if lost on the user side. Personalities consistent with the toy morphology are maintained by way of the toy ID.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An interactive toy comprising:

a microphone for converting acoustic energy into corresponding electrical signals;

a speaker for generating audible information;

a networking interface for connecting to a network;

a memory comprising:

networking software for controlling the networking interface;

control software capable of executing a plurality of tasks according to a corresponding plurality of commands;

a toy identifier;

audio data; and audio output software for generating the audio signals according to the audio data;

a processing system for executing the control software, the networking software, and audio output software; and a speech recognition system for generating at least one of the commands according to the electrical signals from the microphone and providing the command to the control software;

wherein the commands include a download command, and in response to the download command received from the speech recognition system, the control software directs the networking software to interface with a network server over the network to obtain the audio data.

2. The interactive toy of claim 1 wherein when performing the download command, the networking software provides the network server with the toy identifier, and the network server provides the audio data according to the toy identifier.

3. The interactive toy of claim 2 wherein the memory further comprises a unique identifier, and the networking software provides the unique identifier to the network server.

4. The interactive toy of claim 3 wherein the network server provides the audio data according to both the toy identifier and the unique identifier.

5. The interactive toy of claim 1 further comprising a liquid crystal display (LCD), and the control software controls the LCD according to the command received from the speech recognition system.

6. The interactive toy system of claim 1 wherein the audio data comprises verbal story data.

7. The interactive toy system of claim 1 wherein the audio data comprises music data.

8. An interactive toy system comprising:

a toy comprising:

a microphone for converting acoustic energy into corresponding electrical signals;

a speaker for generating audible information; and a first memory for storing a toy identifier;

a processing system comprising:

a networking interface for connecting to a network;

an audio interface for accepting the electrical signals from the microphone, and for providing audio signals to the speaker to generate the audible information; and a second memory comprising:

networking software for controlling the networking interface;

control software capable of executing a plurality of tasks according to a corresponding plurality of commands;

audio data; and audio output software for generating the audio signals according to the audio data; and a speech recognition system for generating at least one of the commands according to the electrical signals from the microphone and providing the command to the control software; and a network server connected to the network for providing data to the processing system;

wherein the commands include a download command, and in response to the download command received from the speech recognition system, the control software directs the networking software to interface with the network server to obtain the audio data.

9. The interactive toy system of claim 8 wherein when performing the download command, the networking software provides the network server with the toy identifier, and the network server provides the audio data according to the toy identifier.

10. The interactive toy system of claim 9 wherein the first memory further stores a unique identifier, and the networking software provides the unique identifier to the network server.

11. The interactive toy system of claim 10 wherein the network server provides the audio data according to both the toy identifier and the unique identifier.

12. The interactive toy system of claim 8 wherein the processing system is disposed within the toy.

13. The interactive toy system of claim 8 wherein the toy further comprises a liquid crystal display (LCD), and the control software controls the LCD according to the command received from the speech recognition system.

14. The interactive toy system of claim 8 wherein the audio data comprises verbal story data.

15. The interactive toy system of claim 8 wherein the audio data comprises music data.

* * * * *